US005166732A

United States Patent [19]

Fuji

[11] Patent Number: 5,166,732

[45] Date of Patent: Nov. 24, 1992

[54] DEVELOPER AGITATING METHOD AND DEVELOPER AGITATING APPARATUS

[75] Inventor: Kazuo Fuji, Higashiosaka, Japan

[73] Assignee: Mita Industrial Co., Ltd., Japan

[21] Appl. No.: 756,032

[22] Filed: Sep. 6, 1991

[30] Foreign Application Priority Data

Sep. 14, 1990 [JP] Japan ..... 2-245283
Sep. 14, 1990 [JP] Japan ..... 2-245284

[51] Int. Cl.[5] ..... G03G 15/06
[52] U.S. Cl. ..... 355/245; 366/327
[58] Field of Search ..... 355/245, 246; 366/327

[56] References Cited

U.S. PATENT DOCUMENTS 3,167,455 1/1965 Laben et al. ..... 118/657
4;586,059 4/1986 Matsuura ..... 355/298 X
4,784,081 11/1988 Knott ..... 355/253 X
4,937,625 6/1990 Kato et al. ..... 355/245
4,963,929 10/1990 Ueda et al. ..... 355/246 X
5,012,286 4/1991 Kawano et al. ..... 355/246

FOREIGN PATENT DOCUMENTS 59-100472 6/1984 Japan .
63-298369 12/1988 Japan .
1-61779 3/1989 Japan .

*Primary Examiner*—A. T. Grimley
*Assistant Examiner*—Nestor R. Ramirez
*Attorney, Agent, or Firm*—Beveridge, DeGrandi & Weilacher

[57] ABSTRACT

In a developer agitating method, a carrier and a toner are mixed by a spiral in an agitating passage to provide the developer. The developer is conveyed along the axis of the spiral through a high conveying speed section of the passage wherein the developer is agitated in a manner such that a part of the spiral is exposed by extending out of the developer. The developer is conveyed from the high-speed section to a low-speed section wherein the mixture rate of the toner and the carrier is detected. In a preferred embodiment, high-speed and low-speed conveying are controlled according to the pitch of the fans of the spiral. In another preferred embodiment of a developer agitating apparatus, the spiral is arranged with a restricting member which reduces the performance of developer carrying in the vicinity of the toner density sensor, but not at the toner supply mouth.

6 Claims, 6 Drawing Sheets

DEVELOPER AGITATING METHOD AND DEVELOPER AGITATING APPARATUS

BACKGROUND OF THE INVENTION

1. Field of the Invention

The present invention relates to a developer agitating method and a developer agitating apparatus which are employed for image forming apparatuses such as electro-photographic copying machines, printers, etc.

2. Description of the Prior Arts

Multi-color electrophotographic copying machines are provided with a plurality of developer units. Therefore, in order to prevent the whole body of the copying machine from increasing in size, it is required to make each developer unit compact.

However, in trying to design a compact developer unit by use of a method where a developer consisting of toner and carrier is circulated in a rotation direction of a sleeve similar to a standard copying machine, since a circulation direction of the developer is extremely small, supplied toner is not sufficiently mixed with the developer and, consequently, is not sufficiently charged, so that the toner scatters.

Conventionally, a method has been employed, for compact developer units, where an agitation direction is increased, as shown in FIG. 1, by circulating the developer by use of a spirals 10*a* and 10*b* on an agitating passage 45 along a partition 15 in a direction along a development sleeve 20. The arrows in FIG. 1 show the direction of the flow of the developer. Also, a T/D (wherein T represents an amount of toner and D represents an amount of developer) of the developer is sensed by a toner density sensor 30 consisting of a permeability sensor provided at the bottom of the agitating passage 45 to control an amount of toner supplied through a toner supply mouth 60.

When a spiral is used for agitating and carrying developer as described above, the amount of developer which is provided in a developer unit is an important factor for controlling the T/D of the developer.

That is, when a tip of a fan of the spiral 10*a* is sufficiently exposed out of the developer, the developer is pushed toward a proceeding direction while crumbling like an avalanche between the fans against a rotation direction, which is the best condition for the agitation by a spiral.

However, when the T/D is sensed by the toner density sensor 30 which is provided at the bottom of the agitating passage 45 and that employs a permeability of the carrier to control an amount of toner, the following inconvenience occurs.

For example, when a toner consuming area of an original is extremely large, the amount of the developer temporarily decreases, so that the spiral 10*a* is over-exposed out of the developer. As a result, the carrier included in the developer hardly contacts the toner density sensor 30 provided at the bottom of the agitating passage 45 because of an increase of air included in the developer, so that a sensing voltage decreases to stop the toner supply. This is because the toner density sensor 30 senses a carrier density in the developer from a permeability of the developer to obtain the T/D.

Moreover, when the toner density temporarily exceeds a reference value so that a fan 12 of the spiral 10*a* is nearly covered with the developer such as when the original to be copied is changed from an original having a large toner consumption area to an original having a small area, the developer on the surface is carried without mixed with the supplied toner. As a result, the supplied toner is carried with the developer on the surface of the developer and is never sensed by the toner density sensor 30 provided at the bottom of the agitating passage 45. Therefore, the toner supply never stops, so that toner is over-supplied to further increase the amount of the developer. Thus, a vicious cycle arises where the fan 12 of the spiral 10*a* is covered with the developer and the further supplied toner is never sensed by the toner density sensor 30 so that the toner scatters out of the developer unit.

SUMMARY OF THE INVENTION

An object of the present invention is to provide a developer agitating method and a developer agitating apparatus where an erroneous sensing of toner density in the developer by the toner density sensor can be prevented.

In a developer agitating method according to the present invention, carrier which is previously provided in an agitating passage and toner which is supplied in the agitating passage through a toner supply mouth are mixed by use of a spiral and where a developer consisting of said toner and carrier is circulated in a direction along an axis of said spiral by use of said spiral, and a section where a speed of carrying the developer is high and a section where a speed of carrying the developer is low are provided in a direction along the axis of the spiral and agitation is performed so that a part of said spiral is exposed out of the developer in the section where the carrying speed is high.

Moreover, a developer agitating apparatus according to the present invention is provided with an agitating passage to which carrier and toner are supplied as a developer, a spiral provided in said agitating passage and having a restricting member, between a part of portions between its fans, for reducing a performance of carrying the developer, a toner density sensor provided at a bottom of a portion, of said agitating passage, where said restricting member is provided and a toner supply mouth provided at an upper part of said agitating passage, where said restricting plate is not provided.

BRIEF DESCRIPTION OF THE DRAWING

This and other objects and features of this invention will become clear from the following description taken in conjunction with the preferred embodiments with reference to the accompanied drawings in which.

DETAILED DESCRIPTION OF THE PREFERRED EMBODIMENT

An embodiment of the present invention will hereinafter be described with reference to the drawings.

Figure 1:
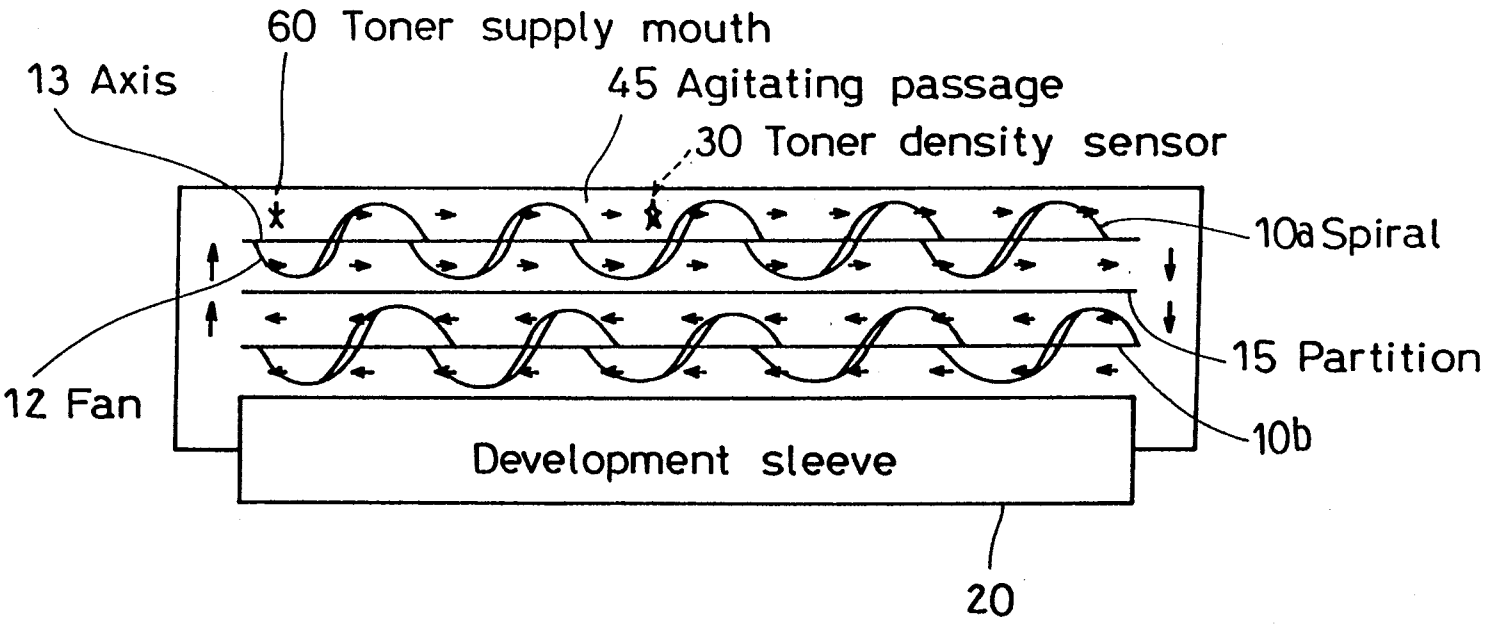
Fig. 1 Prior art
FIG. 1 is a cross-sectional view of a conventional developer agitating apparatus.
Figure 2:
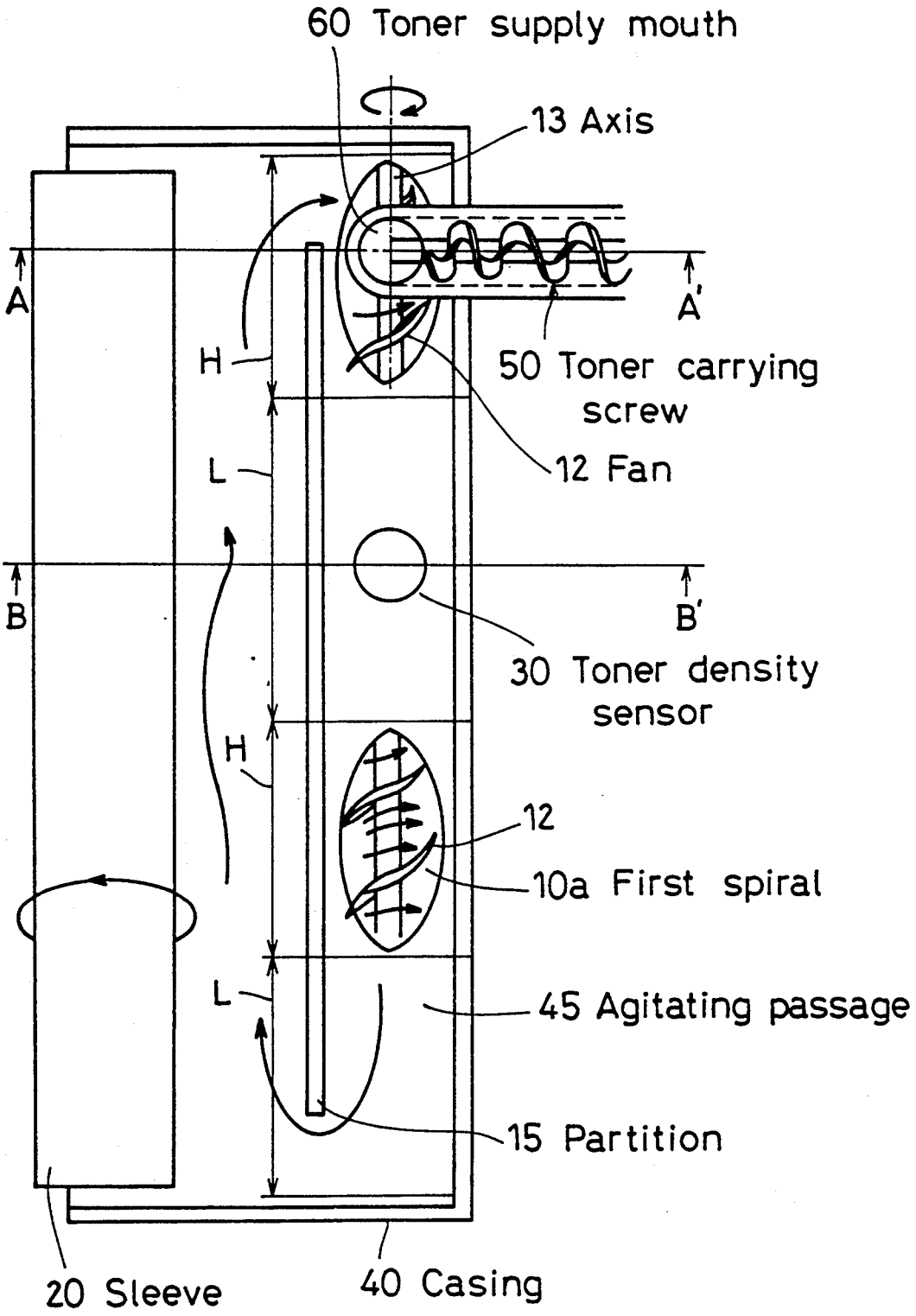
FIG. 2 is a schematic plan view of a developer agitating apparatus according to the present invention.
Figure 4:
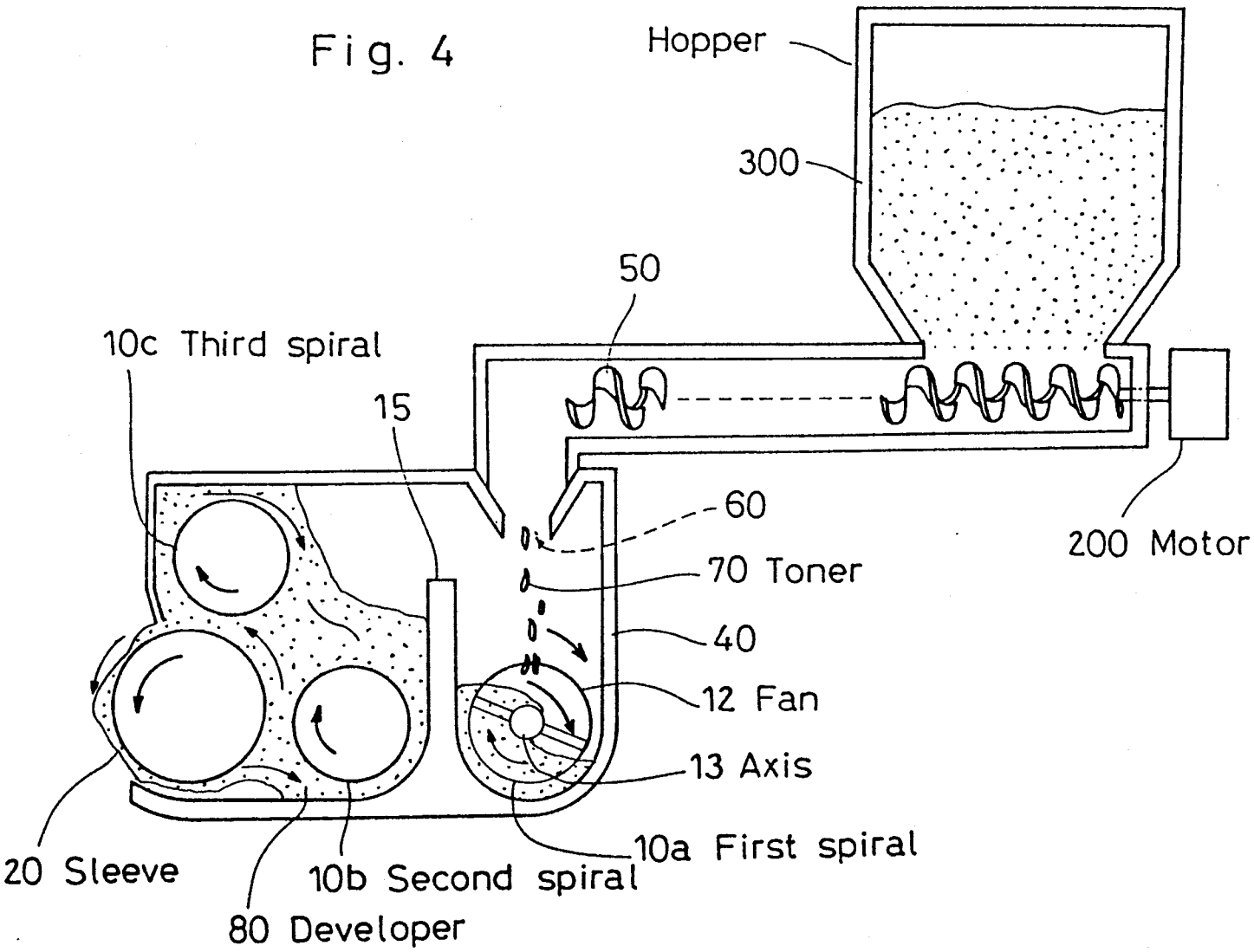
FIG. 4 is a cross-sectional view of FIG. 2 taken on a line A—A′ to which a toner supplying apparatus is added.

FIG. 2 is a plan view of a developing apparatus where the present invention is incorporated. In a casing 40, a development sleeve 20 is provided at a position opposite to a photoreceptor drum (not shown) so that it is partly exposed out of the casing 40. Moreover, in the casing 40, a partition 15 is provided parallelly to a direction along the development sleeve 20. A toner supply mouth 60 is provided at a portion on the upper surface of the side, with the partition 15 in the center, where the development sleeve 20 is not provided of the casing 40. When a toner carrying screw 50 is rotated, toner 70 is supplied into the casing 40 through the toner supply mouth 60 as shown in FIG. 4 (a cross-sectional view taken on the line A—A' of FIG. 2). Then, the toner 70 is immediately mixed with a developer 80 by a fan 12 of a first spiral 10*a* which is partly exposed out of the developer 80.

Figure 5:
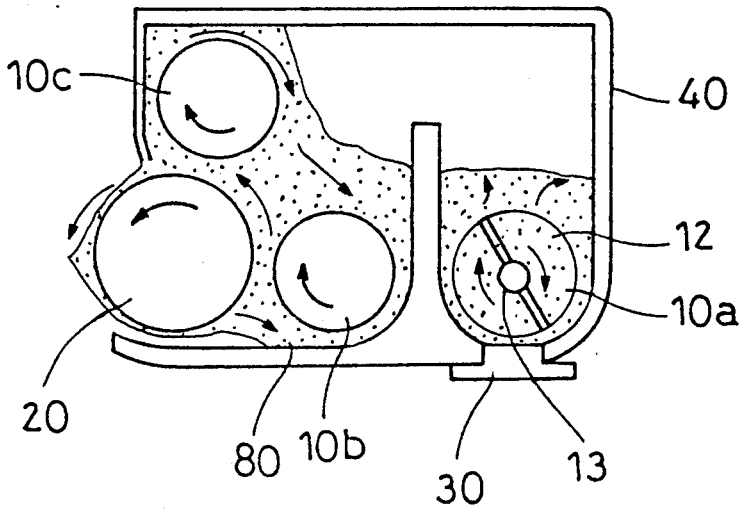
FIG. 5 is a cross-sectional view of FIG. 2 taken on a line B—B′.

The toner supply mouth 60 is provided at an upper surface of the casing 40 as shown in FIGS. 2 and 4, and a toner density sensor 30, at a bottom of the casing 40 as shown in FIGS. 2 and 5. The first spiral 10*a* is provided in an agitating passage 45. The toner density sensor 30 consists of a permeability sensor. A motor 200 which rotates the toner carrying screw 50 is controlled by an output of the toner density sensor 30, whereby a toner supply from the toner supply mouth 60 to the agitating passage 45 is controlled. In FIG. 4, the numeral 300 represents a toner hopper.

Figure 3:
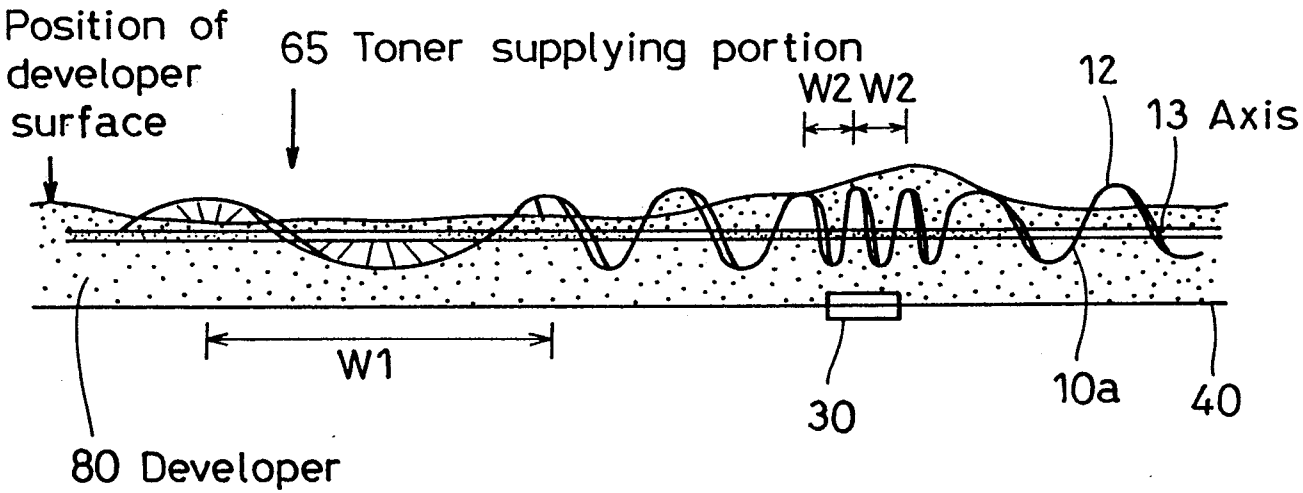
FIG. 3 is a cross-sectional view of FIG. 2 taken on an axis of a spiral.

A pitch W1 of the portions of the first spiral 10*a* which are located below the toner supply mouth 60 is, as shown in FIG. 3, longer than a pitch W2 of the portions of the first spiral 10*a* which are located above the toner density sensor 30. Therefore, the speed of carrying the developer 80 is higher at the portions where the pitch is longer than the portions above the toner density sensor 30. FIG. 2 shows only portions of the first spiral 10*a* where the pitch is longer (that is, where the carrying speed is high) in order to show a condition where the fan 12 of the first spiral 10*a* and an axis 13 are exposed out of the developer 80 because of the high speed of carrying the developer 80. The pitch W2 of the portions of the first spiral 10*a* which is located above the toner density sensor 30 is shorter than the pitch W1 of the portions of the first spiral 10*a* which is located below the toner supply mouth 60. Therefore, the speed of carrying the developer 80 is lower at the portions where the pitch is shorter than at the portions where the pitch is longer. Therefore, the first spiral 10*a* is sufficiently covered with the developer 80 as shown in FIG. 5 (a cross-sectional view taken on the line B—B' of FIG. 2), so that the toner density sensor 30 and the developer 80 satisfactorily contact. When a T/D sensed by the toner density sensor 30 is smaller than a predetermined value, the motor 200 rotates to rotate the toner carrying screw 50, so that the toner 70 is supplied through the toner supply mouth 60. Moreover, as shown in FIG. 2, the portion where the pitch is short (a low-speed section) L and the portion where the pitch is longer (a high-speed section) H are alternately formed. Therefore, as shown in FIG. 3, the longer the pitch is, the more the first spiral 10*a* is exposed out of the developer 80, and the shorter the pitch is, the more the first spiral 10*a* is covered with the developer 80.

The amount of the developer 80 is controlled so that a part of the first spiral 10*a* is exposed out of the developer 80, for example, so that the height of the developer 80 does not exceed the height (a height from the bottom of the agitating passage 45) of an axis 90 of the first spiral 10*a* at the portions where the pitch is longer. As a result, the toner supplied at the portions where the pitch is longer is swallowed by the developer crumbling like an avalanche against a rotation direction of the first spiral 10*a* and is mixed with the developer.

The developer 80 is heaped up on the portion where the pitch is shorter, and due to the dead load, the excessive developer 80 flows toward the portion where the pitch is longer.

FIG. 3 shows a manner in which the developer 80 is distributed on the agitating passage 45 when the first spiral 10*a* is operated.

Figure 6:
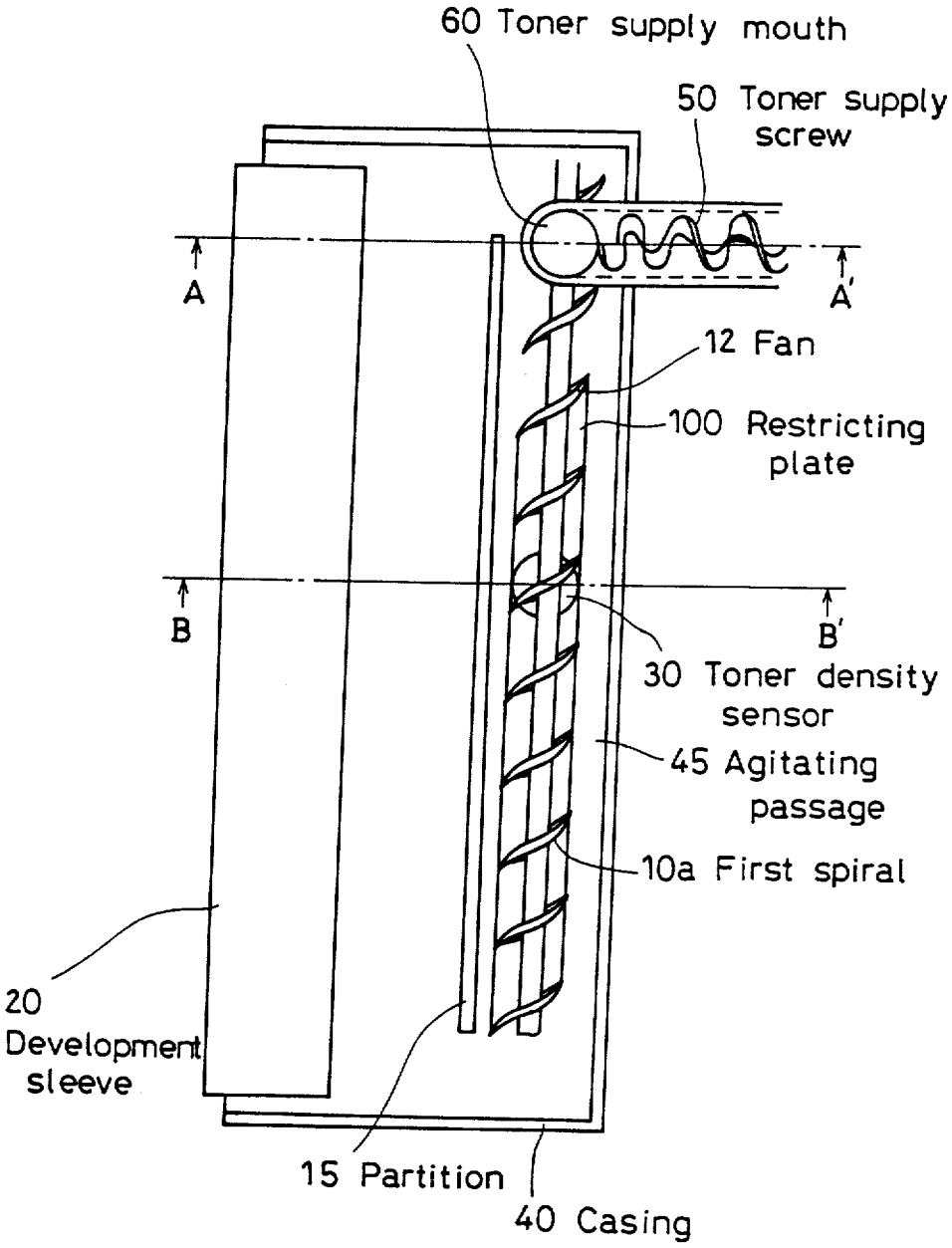
FIG. 6 is a schematic plan view of another embodiment of the present invention.

FIG. 6 shows another embodiment of the present invention. In FIG. 6, the portions that are the same as those shown in FIG. 2 are represented by the same numerals. In this embodiment, although the pitch of the portion of the first spiral 10*a* which is located in the vicinity of the position below the toner supply mouth 60 is the same as that of the other portions of the first spiral 10*a*, a restricting plate 100 for restricting the amount of carried toner is provided between the fans 12 of a portion of the first spiral 10*a* other than the portion in the vicinity of the position below the toner supply mouth. The restricting plate 100 sufficiently rotates the developer in a rotation direction of the spiral 10*a*. Thus, the speed of carrying toner in a direction along the axis decreases. Therefore, the first spiral 10*a* is sufficiently covered with the developer 80 in the vicinity of the toner density sensor 30, so that the toner density sensor 30 and the developer 80 satisfactorily contact. When a T/D sensed by the toner density sensor 30 is smaller than a predetermined value, the toner 70 is supplied through the toner supply mouth 60. The restriction plate 100 is not provided between the fans 12 of the first spiral 10*a* in the vicinity of the portion below the toner supply mouth 60. Therefore, the portion of the spiral barely rotates the developer around the axis, and thus, the speed of carrying the developer along the axis increases. For this reason, the developer remains for only a short period of time and the amount of the developer decreases. As a result, the fan of the spiral is exposed, and the toner supplied therein is swallowed up by the developer crumbling like an avalance between the fans against a rotation direction, is immediately mixed with the developer and is uniformly dispersed in the developer.

Figure 7:
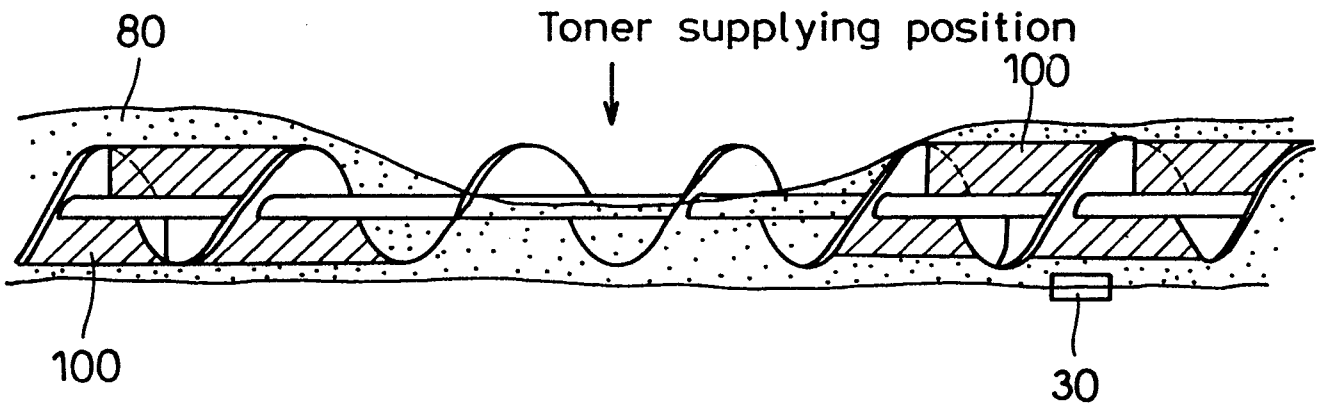
FIG. 7 is a cross-sectional view of FIG. 6 taken on an axis of a spiral.

FIG. 7 shows a manner in which the developer 80 is distributed on the agitating passage 45 when the first spiral 10*a* is operated.

In either of the above-described two embodiments, there exist along the axis of the spiral portions where a speed of carrying the developer is high and where the speed is low. The toner supply mouth is provided in the portion where the speed is high, and the toner density sensor is provided in the portion where the speed is low. Thus, the developer remains for only a short period of time in the vicinity of a position below the toner supply mouth so that only a small quantity of developer exists. Furthermore, a part of the spiral is exposed out of the developer. Therefore, the toner supplied therein is swallowed up by the developer crumbling like an avalanche between the fans against a rotation direction, is immediately mixed with the developer and is uniformly dispersed in the developer.

On the other hand, in the vicinity of the toner density sensor, the speed of carrying the developer is low, so that the developer remains there for a longer period of time to increase the amount of the developer. Therefore, the toner is easily contact the toner density sensor, so that a correct toner density is detected.

Obviously, many modifications and variations of the present invention are possible in light of the above teachings. It is therefore to be understood that within the scope of the appended claims, the invention may be practiced other than as specifically described.

What is claimed is:

1. A developer agitating method for developer comprising a toner and a carrier, said method comprising the steps of:

providing said carrier in an agitating passage;

supplying said toner to said agitating passage through a toner supply mouth;

mixing said toner and said carrier in said passage by means of a spiral to agitate said toner and said carrier and provide said developer, and to convey said developer along the axis of said spiral;

conveying said developer along said axis through a high-speed section of said passage wherein portions of said spiral are exposed by extending outward from said developer, said toner being supplied through said supply mouth at said high-speed section;

conveying said developer along said axis from said high-speed section to a low-speed section whereby a relatively larger amount of developer is present in said low-speed section than is present in said high-speed section; and detecting a mixture rate of said carrier and said toner in said low-speed section.

2. A developer agitating method as claimed in claim 1, wherein to form said low-speed section, a restricting plate for reducing performance of developer carrying is provided between fans of said spiral.

3. A developer agitating method as claimed in claim 1, wherein said low-speed section is formed by a portion of the fan of said spiral which has a short pitch.

4. A developer agitating method as claimed in claim 1, wherein said high-speed section is formed by a portion of the fan of said spiral which has a long pitch.

5. A developer agitating method as claimed in claim 1, wherein a toner density sensor for detecting said mixture rate is provided at a bottom of said agitating passage in said low-speed section.

6. A developer agitating apparatus comprising:

means defining an agitating passage into which carrier and toner are supplied to form a developer;

a spiral member provided in said passage, said spiral member including a portion which has a fan with a relatively long pitch disposed in a high conveyance speed section of said passage, and a portion which has a fan with a relatively short pitch disposed in a low conveyance speed section of said passage, said spiral member portion with said relatively long pitch being exposed by extending out from said developer as said developer is conveyed through said high conveyance speed section toward said low conveyance speed section, said spiral member agitating said developer such that a relatively larger amount of toner is present in said low conveyance speed section than is present in said high conveyance speed section;

a toner supply mouth located to supply toner to said high conveyance speed section; and a toner density sensor disposed in said low conveyance speed section for detecting the mixing rate of said toner and carrier.

* * * * *

UNITED STATES PATENT AND TRADEMARK OFFICE

CERTIFICATE OF CORRECTION

PATENT NO. : 5,166,732

DATED : November 24, 1992

INVENTOR(S) : Kazuo Fuji

It is certified that error appears in the above-identified patent and that said Letters Patent is hereby corrected as shown below:

IN THE DRAWINGS:

Please add Figure 6 as shown on the attached sheet

Signed and Sealed this

Twenty-fifth Day of January, 1994

*Attest:*

Bruce Lehman

BRUCE LEHMAN

*Attesting Officer*

*Commissioner of Patents and Trademarks*